US005788113A

United States Patent [19]

Yeh

[11] Patent Number: 5,788,113

[45] Date of Patent: Aug. 4, 1998

[54] HANDLE PIECE WITH ROTATABLE ASSEMBLY

[76] Inventor: Frank Yeh, 1019 N. Mayflower St., Anaheim, Calif. 92801

[21] Appl. No.: 919,688

[22] Filed: Aug. 28, 1997

[51] Int. Cl.[6] ..... B65D 25/28

[52] U.S. Cl. ..... 220/756; 446/267; 446/489; 220/755; 220/752

[58] Field of Search ..... 220/756, 755, 220/757, 752, 759, 753, 703, 710.5, 4.24, 4.21, 735, 890; 215/369, 398; 16/114, DIG. 12

[56] References Cited

U.S. PATENT DOCUMENTS

| | | | |
|---|---|---|---|
| 476,343 | 6/1892 | White . | |
| 2,605,945 | 8/1952 | Dechar | 220/756 |
| 4,261,121 | 4/1981 | Coon . | |
| 4,928,412 | 5/1990 | Nishiyama . | |
| 4,932,542 | 6/1990 | Chen et al. . | |
| 5,031,803 | 7/1991 | Chen . | |
| 5,339,549 | 8/1994 | David et al. . | |
| 5,484,081 | 1/1996 | Jghn | 220/756 |
| 5,492,246 | 2/1996 | Bailey . | |
| 5,545,447 | 8/1996 | DeMars | 215/396 |
| 5,551,933 | 9/1996 | Washburn . | |
| 5,558,240 | 9/1996 | Karp | 215/398 |
| 5,586,682 | 12/1996 | Yeh . | |
| 5,626,248 | 5/1997 | McConnell et al. . | |

FOREIGN PATENT DOCUMENTS

| | | |
|---|---|---|
| 58088 | 3/1913 | Australia . |

*Primary Examiner*—Stephen J. Castellano
*Attorney, Agent, or Firm*—Raymond Sun

[57] ABSTRACT

An assembly is provided that includes a beverage container having a handle extending radially from the container in a direction that defines a handle axis. The assembly further includes a handle grip piece for connection to the handle of the container, and a support bar attached to the handle grip piece. A rotatable object is coupled to the support bar and defines an axis of rotation located in a plane extending at an angle from the handle axis such that the axis of rotation does not intersect the container.

15 Claims, 2 Drawing Sheets

FIG. 4.A

HANDLE PIECE WITH ROTATABLE ASSEMBLY

BACKGROUND OF THE INVENTION

1. Field Of The Invention

The present invention relates to a handle grip piece for use in allowing the user to more easily grip the handle of a mug, and in particular, to a handle grip piece that includes a rotatable object for providing stress relief and amusement.

2. Description Of The Related Art

There currently exist drinking mugs and containers that incorporate rotatable beads or balls providing therapeutic stress-relief or amusement to the user. For example, U.S. Pat. No. 5,626,248 to McConnell et al. disclose a number of embodiments where a rotatable object is secured to the handle of a mug or beverage container. These rotatable objects are positioned so that a user can use his or her fingers to play with these objects, thereby providing amusement value and helping the user to relieve stress. In some embodiments, McConnell et al. disclose the provision of detachable rotatable objects.

While McConnell et al. provide a number of different ways for orienting and configuring their rotatable objects, all of these rotatable objects are attached in close proximity to the handle, and many are provided integrally with the handle. As a result, these rotatable objects are rather difficult to manipulate when the user is gripping the handle of the mug. In particular, most of the rotatable objects can only be conveniently manipulated by a user's thumb when the user is gripping the handle.

In addition, unless McConnell et al.'s rotatable objects are provided at a very large size, the size of the handles in McConnell et al.'s mugs will be very small. In either case, having either an overly large rotatable object, or a handle that is small in proportion to the size of the mug, will make it difficult for the user to securely grip the handle, thereby affecting the stability of the mug or beverage container. Moreover, since McConnell et al. provide their rotatable objects very close to, or integral with, the handle, the user's grip of the handle is often interfered with or not completely stable.

U.S. Pat. No. 5,492,246 to Bailey is similar to U.S. Pat. No. 5,626,248 to McConnell et al. in that a rotatable counting disc is integrally attached to the top of the handle.

U.S. Pat. No. 4,932,542 to Chen et al. and U.S. Pat. No. 5,031,803 provide rotatable objects in the body of the mug or beverage container, away from the handle. Therefore, it is not possible to play with these rotatable objects when the user is gripping the handle of the mug or beverage container.

Thus, there still remains a need to provide a mug or beverage container having increased stress-relief and amusement value, and variety in use, while maintaining the safety and stability of the mug or beverage container when it is in use.

SUMMARY OF THE INVENTION

The objects of the present invention may be achieved by providing an assembly having a beverage container with a handle extending radially from the container in a direction that defines a handle axis. The assembly further includes a handle grip piece for connection to the handle of the container, and a support bar attached to the handle grip piece. A rotatable object is coupled to the support bar and defines an axis of rotation located in a plane extending at an angle from the handle axis such that the axis of rotation does not intersect the container.

According to one embodiment of the present invention, the axis of rotation is located in a plane extending generally parallel to the horizontal axis.

According to another embodiment of the present invention, the axis of rotation is located in a plane extending at an angle with respect to the horizontal axis.

The rotatable object according to one embodiment is supported on a shaft that is supported in a body member. The body member is coupled to the support bar. The support bar can be straight or bent.

The rotatable object according to another embodiment has a bore which receives the support bar.

The handle grip piece may include first and second side pieces, each having an inner edge and an arcuate outer surface facing the wall of the mug. Each of the first and second side pieces further includes structure for connecting the respective side piece to a portion of the handle. Mechanisms are provided along the inner edges of the first and second side pieces for connecting the first side piece to the second side piece. Each of the first and second side pieces may also include an upper extension and a lower extension separated by a central portion. The support bar may be attached to the central portion, the upper extension or the lower extension. In addition, the support bar may be removably attached to the handle grip piece.

According to yet another embodiment of the present invention, the assembly includes a beverage container having a handle extending radially from the container in a direction that defines a handle axis, and a handle grip piece for connection to the handle of the container. The assembly further includes a strap member wrapped around the handle grip piece and the handle, with a support bar attached to the strap member. A rotatable object is coupled to the support bar and defines an axis of rotation located in a plane extending at an angle from the handle axis such that the axis of rotation does not intersect the container.

Thus, the assemblies according to the present invention provide the user with a great deal of flexibility in positioning the rotatable assemblies at one of many possible locations. These locations can be adjusted in all three dimensions. These features provide increased variety of play and use, thereby enhancing the stress-relief and amusement value of the assemblies of the present invention. The assemblies according to the present invention are also safe to use since the user can grip the handle and conveniently manipulate the rotatable objects without tilting or rocking the beverage container.

BRIEF DESCRIPTION OF THE DRAWINGS

FIG. 4A is a side plan view of a rotatable assembly according to another preferred embodiment of the present invention;

DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides a handle grip piece that can be removably attached to the handle of a mug or beverage container. One or more rotatable objects are provided with the handle grip piece and are spaced apart from the handle grip piece. The rotational axis of these rotatable objects does not intersect the body of the mug or beverage container. As a result, the rotational object(s) can be safely manipulated by a user's thumb and index finger even when the user is gripping the handle, without fear of tilting or rocking the mug or beverage container.

My previous U.S. Pat. No. 5,586,682 has provided a handle grip piece that can be removably attached to a handle of a conventional mug or beverage container. The handle grip piece improves the user's grip of the mug or container, and can be removed from one mug or container and used with other mugs or containers. The entire disclosure of U.S. Pat. No. 5,586,682 is therefore incorporated by this reference as though set forth fully herein.

The present invention is applicable to mugs and beverage containers alike, which shall be collectively referred to hereinafter as "mug". Although the handle grip pieces described hereinbelow are described and illustrated as being adapted for use with conventional or standard handles, the present invention is not so limited and may also include handle grip pieces provided in certain specific shapes and sizes for specific use with mugs having handles with special sizes or shapes. All such handle grip pieces are likewise removable and easy to deploy.

Figure 1:
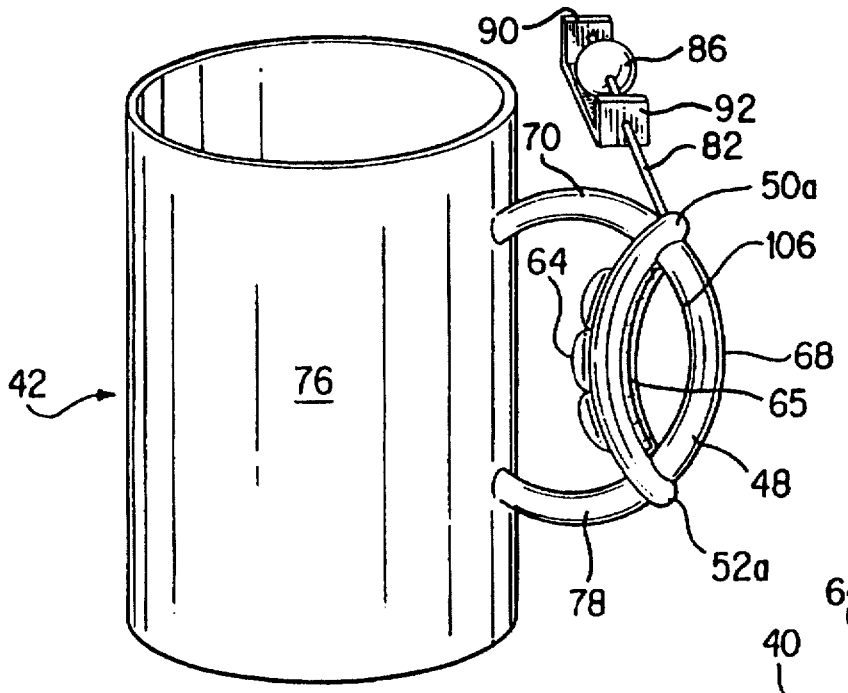
FIG. 1 is a perspective view of a handle grip piece and rotatable assembly according to a first preferred embodiment of a handle grip piece and rotatable object according to the present invention shown in use with the handle of a conventional mug.
Figure 2:
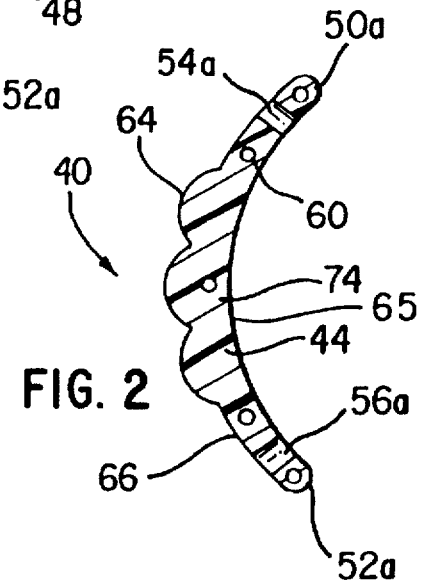
FIG. 2 is a cross-sectional side view of the handle grip piece and rotatable object of FIG. 1.
Figure 3:
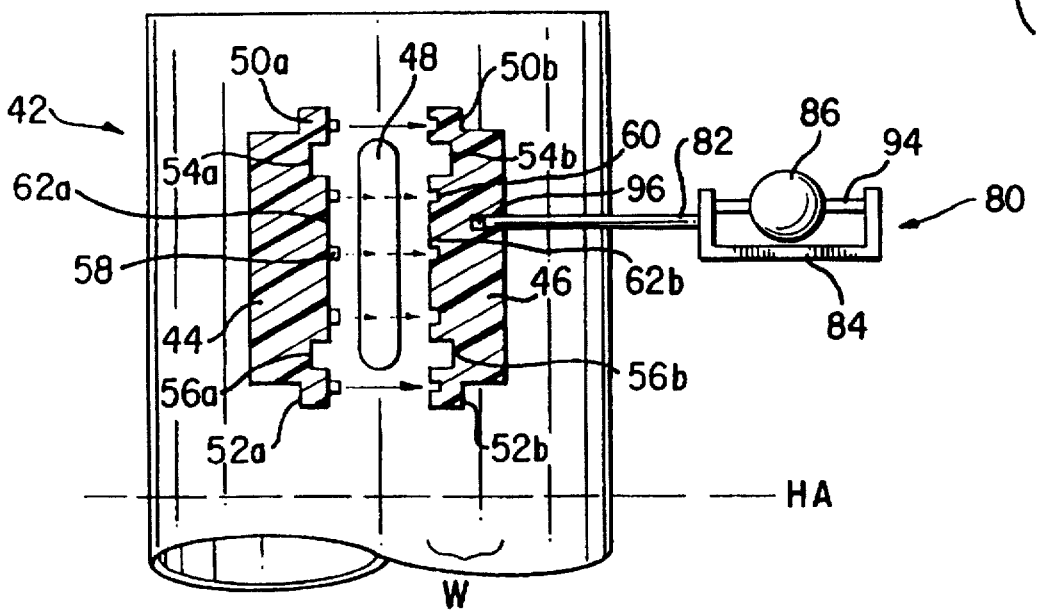
FIG. 3 is an exploded sectional side view of a conventional mug illustrating how the handle grip piece and rotatable assembly of FIG. 1 is deployed at the handle of the mug.
Figure 5:
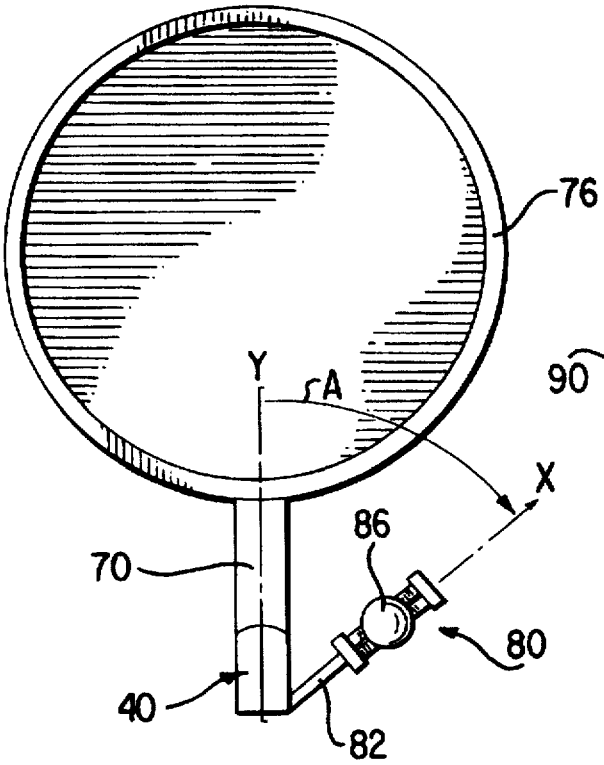
FIG. 5 is a top plan view of the handle grip piece and rotatable assembly of FIG. 1 shown in use with a conventional mug.
Figure 4:
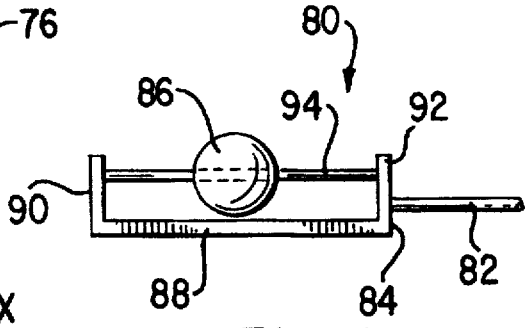
FIG. 4 is a side plan view of a rotatable assembly according to a preferred embodiment of the present invention.

The handle grip piece 40 in accordance with a first preferred embodiment of the present invention is shown in FIGS. 1–3 in use with a conventional mug 42. The handle grip piece 40 has two separate side pieces 44 and 46 that are adapted to be coupled or connected when deployed at the handle 48 of the mug 42. Each side piece 44 and 46 is preferably an arcuate or curved strip as shown in FIG. 3. Each side piece 44 and 46 has an upper extension 50*a* and 50*b*, respectively, and a lower extension 52*a* and 52*b*, respectively. Each side piece 44 and 46 further includes an upper recess 54*a* and 54*b*, respectively, and a lower recess 56*a* and 56*b*, respectively, provided along the inner edges 62*a* and 62*b*, respectively.

The two side pieces 44 and 46 include mechanisms for connecting the two side pieces 44 and 46 to form the unitary handle grip piece 40. In a first preferred embodiment illustrated in FIGS. 2 and 3, the connecting mechanism has male protrusions 58 and female notches 60. Specifically, a plurality of male protrusions 58 are provided along the inner edge 62*a* of one side piece 44, and are adapted to be received in and engaged by a corresponding number of opposing female notches 60 provided along the inner edge 62*b* of the other side piece 46. The male protrusions 58 and female notches 60 can be provided along the inner edge of either side piece 44 and 46, as long as the protrusions 58 and the notches 60 are provided at opposing edges. At least three sets of protrusions 58 and notches 60 are preferably provided in spaced-apart manner along the edges 62*a* and 62*b*, with one set provided at the upper extensions 50*a*, 50*b*, one set at the lower extensions 52*a*, 52*b*, and a third set provided between the recesses 54*a*, 54*b* and 56*a*, 56*b*. For example, in the embodiment of FIG. 3, three sets of protrusions 58 and notches 60 are provided between the recesses 54*a*, 54*b* and 56*a*, 56*b*. Although sets of protrusions 58 and notches 60 have been described and illustrated, other alternative mechanisms can be used to connect the side pieces 44 and 46 without departing from the spirit and scope of the present invention. As a non-limiting example, opposing Velcro™ pads can be provided on the side pieces 44 and 46 and used to connect the side pieces 44 and 46.

To deploy the handle grip piece 40, the user separates the two side pieces 44 and 46, and positions one side piece 44 to the left of the handle 48, and the other side piece 46 to the right of the handle 48 (see FIG. 3). The two sets of recesses 54*a*, 54*b* and 56*a*, 56*b* are adapted to receive sides of the two corresponding portions of the handle 48, as shown in FIGS. 1 and 3. Specifically, the upper recesses 54*a*, 54*b* receive a portion of the handle 48 between the central portion 68 and the top portion 70, and the lower recesses 56*a*, 56*b* receive a portion of the handle 48 between the central portion 68 and the bottom portion 78. Thus, the recesses 54*a*, 54*b* and 56*a*, 56*b* also function to attach or connect the handle grip piece 40 to the handle 48 when the side pieces 44 and 46 are connected together. The side pieces 44 and 46 are arcuate such that the outer surface 66 at their central portions 74 are closest to the body 76 of the mug 42 and their inner surface 65 are furthest from the central portion 68 of the handle 48, while the upper and lower extensions 50*a*, 50*b* and 52*a*, 52*b* are furthest from the wall 76 of the mug 42.

The two side pieces 44 and 46 are then brought together about the handle 48 and connected together by engaging the male protrusions 58 into the female notches 60. After the two side pieces 44 and 46 have been connected, the handle grip piece 40 formed therefrom will assume the arcuate configuration shown in FIGS. 1 and 2, and the portions of the handle 48 will be secured within the recesses 54*a*, 54*b* and 56*a*, 56*b*. Bumps 64 are provided on the outer surface 66 of the side pieces 44 and 46 to enhance the grip for the user's fingers. The upper extensions 50*a* and 50*b* together act as a thumb rest. When so deployed, the inside of the user's fingers can be rested against the outer surface 66 of the side pieces 44 and 46, and the thumb rested against the upper extensions 50*a*, 50*b*, to provide a more secure and firmer grip. To remove the handle grip piece 40 for use with another mug, the user merely pulls the side pieces 44 and 46 apart, removes them from the handle 48, and deploys them at the handle of another mug.

The side pieces 44 and 46 are preferably made from a strip of hard rubber or plastic material, although other materials such as wood and bamboo, as non-limiting examples, can also be used without departing from the spirit and scope of the present invention. Such a material is preferably hard enough to allow the user's fingers to impart a force against the side pieces 44 and 46 without causing the side pieces 44 and 46 to buckle, yet has sufficient flexibility to allow the user to adjust the position of the handle grip piece 40 along the handle 48. For example, the user may wish to position the upper and lower extensions 50*a*, 50*b* and 52*a*, 52*b* closer to each other along the handle 48 to obtain a more arcuate configuration for the handle grip piece 40, or to position the upper and lower extensions 50*a*, 50*b* and 52*a*, 52*b* further from each other along the handle 48 to obtain a less arcuate configuration for the handle grip piece 40. The thickness of the side pieces 44 and 46 range from about 0.5 mm to 2.0 mm, and is preferably about 1.0 mm. The width W of each side piece 44 and 46 ranges from about 2.5 inches to 4.5 inches. These dimensions are intended merely for illustration only, and are not intended to limit the scope of the present invention.

Referring now to FIGS. 1, 2, 3, 4 and 5, a rotatable assembly 80 is provided at a level which can be above, below, or within the handle 48. The rotatable assembly 80 has a support bar 82 having one end attached to the side piece 46, and an opposite end attached to a body member 84. The support bar 82 may be attached along any part of the side piece 46. For example, although FIG. 3 illustrates the support bar 82 as being attached at a location between the recesses 54*b* and 56*b*, it is also possible to attach the support bar 82 at either the upper extension 50*b* or the lower extension 52*b*. In addition, although the following description will be provided in connection with attachment of the support bar 82 along the side piece 46, those skilled in the art will appreciate that the support bar 82 can also be attached along the side piece 44 using similar techniques.

The body member 84 has a base section 88 and two end wall sections 90, 92, with an end of the support bar 82 connected to one of the end wall sections 92. A shaft 94 is supported between the two end wall sections 90, 92, and extends completely through a rotatable object 86 for rotatably supporting the rotatable object 86.

The support bar 82 and the shaft 94 (which defines the axis of rotation of the rotatable object 86) extend along the same linear axis X at an angle A from an axis Y. The axis Y is defined by the linear path along which the handle 48 extends radially from the body 76 of the mug 42. Angle A is preferably between 15 to 30 degrees so that the rotatable object 86 is positioned at an angle extending sufficiently away from the handle 48 to allow the user to manipulate the object 86 with any of the five fingers, depending on the vertical level at which it is positioned. Assuming that the support bar 82 and the shaft 94 extend substantially parallel to the horizontal axis HA (see FIG. 3), by providing the support bar 82 and rotatable assembly 80 at different vertical levels with respect to the side piece 46, the user can manipulate or play with the object 86 using different fingers. For example, when support bar 82 is attached at a location between the recesses 54*b* and 56*b*, the user can use the three middle fingers to manipulate the object 86. When the support bar 82 is attached at the upper extension 50*b*, the user can use the thumb or index finger. When the support bar 82 is attached at the lower extension 52*b*, the user can use the fourth finger or the pinky finger.

In addition, in one embodiment, the axis X may be provided such that it will not intersect any part of the body 76 of the mug 42. By providing the axis X at an angle A that is large enough so that the axis X will not intersect any part of the body 76 of the mug 42, the rotatable object 86 is positioned at a location that will allow the user to conveniently move the index or other fingers to manipulate the rotatable object 86 without tilting or rocking the mug 42.

As a further alternative, referring specifically to FIG. 3, although the support bar 82 and the shaft 94 are illustrated as extending substantially parallel to the horizontal axis HA, it is also possible to provide the support bar 82 and the shaft 94 at an angle with respect to the horizontal axis HA to further vary the vertical level of the rotatable object 86. Thus, the support bar 82, the rotatable assembly 80, and its shaft 94 can be oriented at a wide variety of angles with respect to the horizontal axis HA, the axis Y of the handle, and the vertical axis (i.e., vertically along the side piece 46), or any combination thereof, to position the rotatable object 86 at a wide variety of locations where the user can manipulate it or play with it.

The support bar 82 can be provided with a particular length so that it separates the rotatable object 86 from the handle 48 by a distance which allows the user to comfortably play with or manipulate the rotatable object 86. In this regard, the support bar 82 can be very short in length so that the rotatable object 86 is very close to the handle 48, or it can have a maximum length that will separate the rotatable object 86 from the handle 48 by a distance which is about the same as the length of a finger. Of course, it is preferable not to provide the length of the support bar 82 with a length that is so long that a user must excessively stretch a finger or tilt the hand in order to reach the rotatable object 86.

In light of the above, the rotatable object 86 of the present invention can be positioned at a variety of positions where a user can easily move one or more fingers to manipulate or play with the object 86 even when the user is gripping the handle 48. It is not necessary to stretch a finger or tilt the hand, or make any other motion that may rock or tilt the mug 42 while the user is gripping the handle 48. This enhances the stress-relief and amusement value, while maintaining the safety and stability of the mug 42 by minimizing spillage of fluids contained inside the mug 42. In addition, by providing the rotatable object 86 offset away from the body 76 of the mug 42, the rotatable object 86 will not take up precious space along the handle 48, thereby making it easy for the user to grip and handle the mug 42.

FIG. 4A illustrates an alternative assembly 80*a* to the rotatable assembly 80, in which a rotatable object 86*a* is rotatably supported by the support bar 82*a* (acting as a shaft) which does not extend completely through the object 86*a*, but extends through only a portion of a bore 85 of the object 86*a* (shown in phantom). Thus, the embodiment of FIG. 4A essentially omits the body member 84, although it functions and is positioned similarly to the rotatable assembly 80.

The rotatable objects (such as 86*a*, 86*b*) according to the present invention can be any object, including a ball, a bead, and objects shaped as a football, a basketball, a golf ball, or a baseball, a pineapple, an apple, among others.

The rotatable assemblies 80 and 80*a* can be provided in a manner in which they are integrally attached to the side piece 46 so that they cannot be removed without breaking the support bar 82, 82*a*, or they can be provided in a manner in which they can be detached or removed from the side piece 44 or 46. For example, the side piece 44 or 46 can be provided with a bore 96 (see FIG. 3) that extends partially into the side piece 46 for receiving an end of the support bar 82 or 82*a*. The support bar 82 or 82*a* can then be removed from the side piece 46 if desired.

The rotatable assemblies 82, 82*a* are well suited for use by a right hand of the user. To allow use by the left hand, it is also possible to provide the rotatable assemblies 82, 82*a* with the side piece 44 instead of, or in addition to, the provision of rotatable assemblies 82, 82*a* with the side piece 46. In addition, it is also possible to provide more than one rotatable object 86 on the shaft 94 of the body member 84.

For example, the shaft 94 can rotatably support a plurality if differently-shaped objects 86 along a string. Alternatively, the rotatable assembly 80*a* in FIG. 4A can be modified so that the support bar 82 extends completely through one or more rotatable objects and is received inside the bore 85 of rotatable object 86*a* to form another string of rotatable objects.

Figure 6:
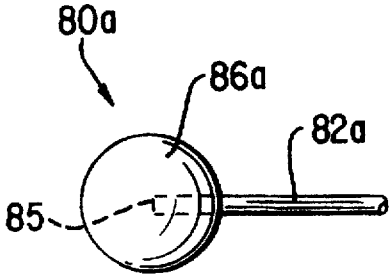
FIG. 6 is a top plan view of a rotatable assembly according to yet another preferred embodiment of the present invention.
Figure 6:
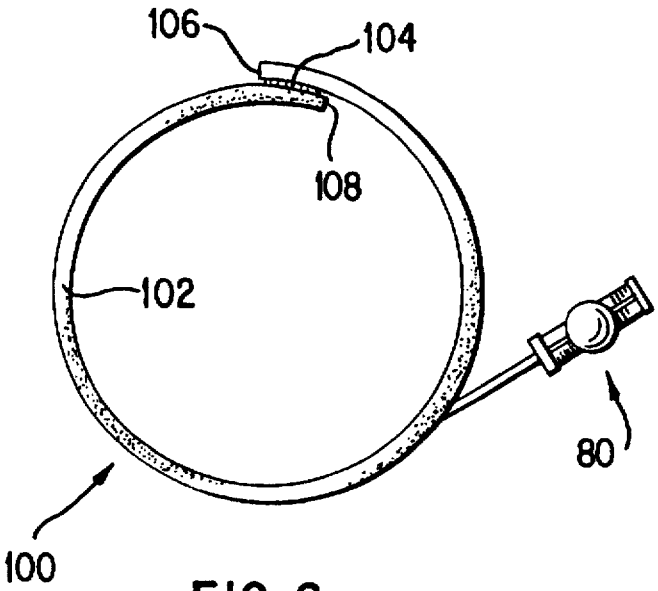

FIG. 6 illustrates yet another embodiment of a rotatable assembly 100 according to the present invention. The rotatable assembly 100 has a strap member 102 with a rotatable assembly 80 or 80*a* permanently or removably attached to the strap member 102 along its circumference in the manner described above for attaching the support bars 82, 82*a* to the side piece 46. Appropriate connection mechanisms 104 (non-limiting examples include opposing Velcro™ pads, hooks, fasteners, ties or latches) are provided at the opposing ends 106, 108 of the strap member 102 to seal the strap member 102 to form a ring-like configuration. In use, the strap member 102 may be wrapped around any portion of the handle 48 and handle grip piece 40, and its ends 106, 108 connected or tied off to position the rotatable assembly 80 or 80*a* adjacent to the handle grip piece 40 and the handle 48.

Figure 7:
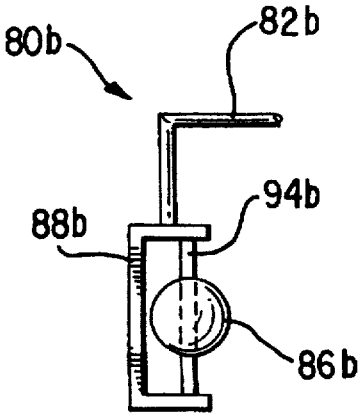
FIG. 7 is an exploded sectional side view of a conventional mug illustrating modifications that can be made to the rotatable assembly of FIG. 1 when it is deployed at the handle of the mug.

Many modifications can be made to the rotatable assembly 80. For example, the shape of the support bar 82 can be varied, or the rotatable assembly 80 can be inverted. FIG. 7 illustrates a rotatable assembly 80*b* that is inverted, or turned upside-down, from the orientation of rotatable assembly 80 so that the base section 88*b* is above the rotatable object 86*b*. In addition, the support bar 82*b* is bent downwardly at an angle. As another alternative, the support bar 82 of assembly 80 in FIG. 4 can be bent upwardly or downwardly at different angles.

Thus, the handle grip piece 40 and rotatable assemblies 80, 80*a*, 80*b*, 100 according to the present invention provide the user with a great deal of flexibility in positioning the rotatable assembly at one of many possible locations. These locations can be adjusted in all three dimensions (vertical, horizontal, and with respect to the axis Y of the handle 48). These features provide increased variety of play and use, thereby enhancing the stress-relief and amusement value of the handle grip piece 40 and rotatable assembly of the present invention. The handle grip piece 40 and rotatable assemblies 80, 80*a*, 80*b*, 100 according to the present invention are also safe to use since the user can grip the handle 48 and conveniently manipulate the rotatable objects 86, 86*a*, 86*b* without tilting or rocking the mug 42. In addition, the rotatable assemblies 80, 80*a*, 80*b*, 100 can be used with different mugs since they can be detached from the handle grip piece 40, or the handle grip piece 40 itself can be detached.

Although the present invention has been described in connection with the preferred embodiments, it will be appreciated by those skilled in the art that modifications can be made and alternatives utilized without departing from the spirit and scope of the present invention. For example, the configuration and size of the mug 42 is not critical. As a further non-limiting example, the shape of the side pieces 44, 46 are not critical, although they must be sized and configured to fit the handle of the intended mug.

What is claimed is:

1. An assembly comprising:

a beverage container having a handle extending radially from the container in a direction that defines a handle axis;

a handle grip piece for connection to the handle of the container;

a support bar attached to the handle grip piece;

a rotatable object coupled to the support bar and defining an axis of rotation located in a plane extending at an angle from the handle axis such that the axis of rotation does not intersect the container.

2. The assembly of claim 1, wherein the container has a bottom surface which is adapted to rest on a surface, and which defines a horizontal axis, wherein the axis of rotation is located in a plane extending generally parallel to the horizontal axis.

3. The assembly of claim 1, wherein the container has a bottom surface which is adapted to rest on a surface, and which defines a horizontal axis, wherein the axis of rotation is located in a plane extending at an angle with respect to the horizontal axis.

4. The assembly of claim 1, wherein the handle grip piece has a central portion, and the support bar is attached to the central portion.

5. The assembly of claim 1, further comprising a body member coupled to the support bar, a shaft supported by the body member and on which the rotatable object is supported for rotation.

6. The assembly of claim 1, wherein the rotatable object has a bore which receives the support bar.

7. The assembly of claim 1, wherein the support bar is removably attached to the handle grip piece.

8. The assembly of claim 1, wherein the handle grip piece comprises:

a first side piece having an inner edge and an arcuate outer surface facing the wall of the mug, the first side piece further including means for connecting the first side piece to a portion of the handle;

a second side piece having an inner edge and an arcuate outer surface facing the wall of the mug, the second side piece further including means for connecting the second side piece to the portion of the handle; and means positioned along the inner edges of the first and second side pieces for connecting the first side piece to the second side piece;

wherein the support bar is attached to the second side piece.

9. The assembly of claim 8, wherein each of the first and second side pieces further includes an upper extension, and wherein the support bar is attached to the upper extension of the second side piece.

10. The assembly of claim 8, wherein each of the first and second side pieces further includes a lower extension, and wherein the support bar is attached to the lower extension of the second side piece.

11. The assembly of claim 8, wherein the means for connecting the first side piece to the second side piece comprises a plurality of protrusions extending from the inner edge of the first side piece, and a plurality of notches provided along the inner edge of the second side piece, wherein the protrusions of the first side piece are adapted to be engaged with the notches of the second side piece to connect the first side piece to the second side piece.

12. The assembly of claim 8, wherein the means for connecting the first side piece to the portion of the handle comprises at least one curved recess adapted to receive the portion of the handle, and wherein the means for connecting the second side piece to the portion of the handle comprises at least one curved recess adapted to receive the portion of the handle.

13. The assembly of claim 12, wherein the handle further comprises a central portion, a top portion and a bottom portion, and wherein the first and second side pieces each comprises an upper curved recess and a lower curved recess, the upper curved recesses of the first and second side pieces adapted to receive and connect the handle at a first location between the central portion and the top portion of the handle, and the lower curved recesses of the first and second side pieces adapted to receive and connect the handle at a second location between the central portion and the bottom portion of the handle.

14. The assembly of claim 1, wherein a plurality of rotatable objects are coupled to the support bar for rotation along the same rotational axis.

15. The assembly of claim 1, wherein the support bar is bent.

* * * * *